US009057500B2

(12) United States Patent
Opolka

(10) Patent No.: US 9,057,500 B2
(45) Date of Patent: Jun. 16, 2015

(54) FLASHLIGHT

(75) Inventor: Rainer Opolka, Solingen (DE)

(73) Assignee: ZWEIBRUEDER OPTOELECTRONICS GMBH & CO. KG, Solingen (DE)

( * ) Notice: Subject to any disclaimer, the term of this patent is extended or adjusted under 35 U.S.C. 154(b) by 981 days.

(21) Appl. No.: 13/175,835

(22) Filed: Jul. 2, 2011

(65) Prior Publication Data

US 2012/0008311 A1 Jan. 12, 2012

(30) Foreign Application Priority Data

Jul. 7, 2010 (DE) ..... 10 2010 026 388

(51) Int. Cl.

| | |
|---|---|
| ***F21V 19/00*** | (2006.01) |
| ***F21L 4/00*** | (2006.01) |
| ***F21L 4/02*** | (2006.01) |
| ***F21V 7/00*** | (2006.01) |
| ***F21V 23/04*** | (2006.01) |
| *F21Y 101/02* | (2006.01) |

(52) U.S. Cl.

CPC ..... *F21V 19/0005* (2013.01); *F21L 4/005* (2013.01); *F21L 4/027* (2013.01); *F21V 7/0075* (2013.01); *F21V 19/006* (2013.01); *F21V 23/0428* (2013.01); *F21Y 2101/02* (2013.01)

(58) Field of Classification Search

CPC ..... F21L 4/027; F21L 4/00; F21L 15/06; F21L 4/005; F21V 23/0414; F21V 7/0075; F21V 19/006; F21V 23/0428; F21V 19/005

USPC ..... 362/202–206, 208

See application file for complete search history.

(56) References Cited

U.S. PATENT DOCUMENTS

| | | | | | |
|---|---|---|---|---|---|
| 4,290,095 | A * | 9/1981 | Schmidt | 362/191 |
| 4,408,261 | A * | 10/1983 | Polakoff | 362/104 |
| 4,459,645 | A * | 7/1984 | Glatter | 362/191 |
| 4,577,263 | A * | 3/1986 | Maglica | 362/187 |
| 4,774,643 | A * | 9/1988 | McGinnis et al. | 362/189 |
| 4,841,417 | A * | 6/1989 | Maglica et al. | 362/206 |
| 4,890,203 | A * | 12/1989 | Watson | 362/102 |
| 4,967,325 | A * | 10/1990 | Shiau | 362/188 |
| 5,008,785 | A * | 4/1991 | Maglica et al. | 362/183 |
| 5,070,437 | A * | 12/1991 | Roberts, Sr. | 362/158 |
| 5,113,329 | A * | 5/1992 | Lin | 362/238 |
| 5,309,337 | A * | 5/1994 | Groben | 362/206 |
| 6,017,129 | A * | 1/2000 | Krietzman | 362/184 |
| 6,050,699 | A * | 4/2000 | Bouffay et al. | 362/203 |
| 6,398,383 | B1 * | 6/2002 | Huang | 362/202 |
| 6,416,198 | B1 * | 7/2002 | Vanderschuit | 362/101 |
| RE40,027 | E * | 1/2008 | Matthews | 429/97 |
| 7,320,530 | B2 * | 1/2008 | Maglica | 362/202 |
| 8,197,083 | B2 * | 6/2012 | Halasz | 362/197 |
| 2005/0122712 | A1 * | 6/2005 | Kim | 362/184 |

* cited by examiner

*Primary Examiner* — Mary McManmon
(74) *Attorney, Agent, or Firm* — Andrew Wilford

(57) ABSTRACT

A flashlight has a casing extending along an axis, formed with a screwthread, and holding a battery having two poles. A light-emitting diode has a light-emitting head and a first and second integral lead wires. A holder is formed with first and second separate throughgoing holes, a seat into which the holes open and in which the diode head is fitted with the first and second wires extending outward through the respective first and second holes out of contact with each other, a reflector adjacent the seat, and a screwthread. The holder is fitted to the casing with the screwthread of the holder operatively engaged with the screwthread of the casing and the first wire pressed directly against one of the poles of the battery.

9 Claims, 8 Drawing Sheets

Fig. 9C
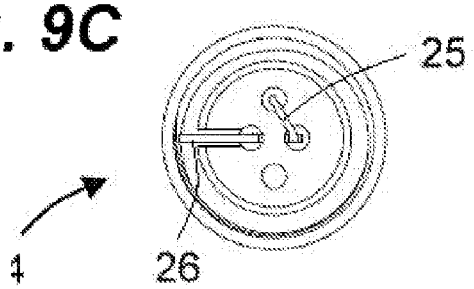
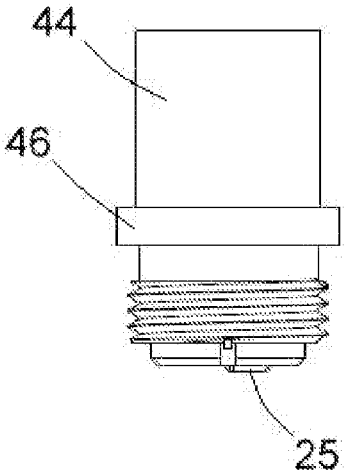
Fig. 9A
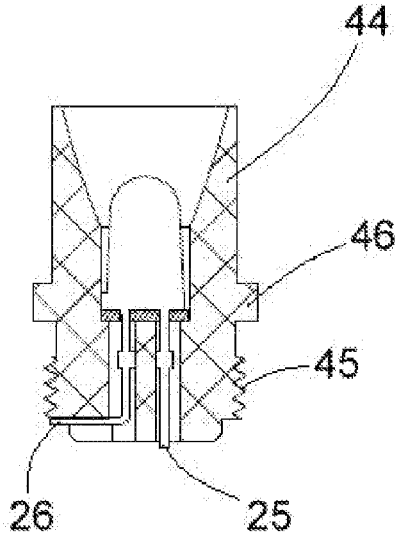
Fig. 9B

FLASHLIGHT

FIELD OF THE INVENTION

The present invention relates to a flashlight. More particularly this invention concerns a flashlight using a light-emitting diode (LED) as a light source.

BACKGROUND OF THE INVENTION

For decades flashlights have been among the indispensable tools for illuminating unlit paths, spaces, including small cavities or sign boards. Conventional flashlights are usually equipped with so-called incandescent bulbs that are screwed into a socket that in turn was one component of an electrical circuit actuatable by a switch. The incandescent bulb was located at the focal point of a concave reflector to focus its light and to ensure the optimal output of light. A relatively large and usually heavy battery functioned as the power supply point and was held in a battery compartment that simultaneously formed the handle of the flashlight.

The disadvantage of incandescent bulbs is their relatively short service life as well as their relatively high power consumption, and for this reason LEDs are widely used as the light source. In addition to longer service lives and lower power consumption, it has also been possible to miniaturize the flashlights, thereby enabling them to be easily carried as a key-chain pendant.

In the prior art, the LEDs are soldered by their lead wires onto a circuit board that in turn has contact points for the battery poles. The disadvantage of this arrangement consists in the relatively costly mode of fabrication and the fabrication defects that cannot be avoided in the soldering process.

OBJECTS OF THE INVENTION

It is therefore an object of the present invention to provide an improved flashlight.

Another object is the provision of such an improved flashlight that overcomes the above-given disadvantages, in particular that is of simple constructive design and can be easily manufactured.

SUMMARY OF THE INVENTION

A flashlight has according to the invention a casing extending along an axis, formed with a screwthread, and holding a battery having two poles. A light-emitting diode has a light-emitting head and a first and second integral lead wires. A one-piece holder is formed with first and second separate throughgoing holes, a seat into which the holes open and in which the diode head is fitted with the first and second wires extending outward through the respective first and second holes out of contact with each other, a reflector adjacent the seat, and a screwthread. The holder is fitted to the casing with the screwthread of the holder operatively engaged with the screwthread of the casing and the first wire pressed directly against one of the poles of the battery.

Thus the LED is mounted without any solder joints in a holder so as to avoid unintentional relative movements of the diode relative to any electrical contacts, which motions in prior-art flashlights result in breakages of the lead wires. The holder not only serves to hold the diode but also is a reflector.

The holder furthermore has holes into which the lead wires can be easily inserted and then retained such that the connections to the battery are created in a solder-free fashion or are arranged such that a connection is made to close the electrical circuit containing the diode by appropriately actuating a switch. The lead wires are thus completely protected externally by the one-piece holder, thereby effectively preventing any accidental breaking of the lead wires since these lead wires are otherwise protected from possible compressive, pulling, or shearing motions.

In a first embodiment of the invention, for example, the flashlight head is rotatable relative to the flashlight casing and thus acts as a rotary switch. In one specific embodiment here, one of the lead wires can extend through the base of the one-piece holder and bent over there so that the wire rests permanently on the positive battery pole of the inserted battery or of the inserted battery pack. The second lead wire extends radially outward through a separate hole where it rests on a front face of the inside side surface of the battery compartment casing, where, depending on the rotational position, the lead wire rests on an insulated point or on an electrically conductive point that is in contact with the negative battery pole. This type of rotary head in the form of a switch is also less prone to wear than pressure-operated switches.

In a special embodiment of the invention, one of the holes passes through the base of the holder and one of the holes passes radially outward, so that lead wires secured herein on the one side make contact with the positive pole and on the other side make contact indirectly through the flashlight casing with the negative pole, that is, the poles of the battery or a battery rod. The lead wires are preferably bent in a U-shape or S-shape at their free ends so as to provide contact lines or contact surfaces.

In order to simplify the construction and facilitate fabrication, another embodiment of the invention provides that the holder can be one piece and provided with an external thread that in the assembled state engages a correspondingly designed internal thread of the flashlight head. In another embodiment of the invention, this internal thread of the flashlight head can also be designed to correspond to the external thread of the flashlight casing, with the result that the internal thread of the flashlight head engages both the external thread of the holder as well as the external thread of the flashlight casing.

In a special embodiment of the invention, the holder can also be composed of an injection-molded plastic part, thereby considerably reducing the cost of manufacture. If translucent plastic is selected as the material for the holder, which additionally includes an annular projection, it is possible to create a shape in which this ring is disposed between the flashlight head and the flashlight casing, the ring preferably fitting flush with the side surface of the flashlight head and the flashlight casing. When the flashlight is switched on, this ring acts an illuminated annular surface that can also be utilized as a support surface for information in another embodiment of the invention. This information can be engraved into the annular surface, in particular by a laser so as to contain technical information or information from the manufacturer, also for advertising purposes.

BRIEF DESCRIPTION OF THE DRAWING

The above and other objects, features, and advantages will become more readily apparent from the following description, reference being made to the accompanying drawing in which:

FIGS. 9A, 9B, and 9C are a side view, a longitudinal section, and a top of a lamp holder with installed LED according to FIGS. 8A-8C;

DETAILED DESCRIPTION

Figure 1:
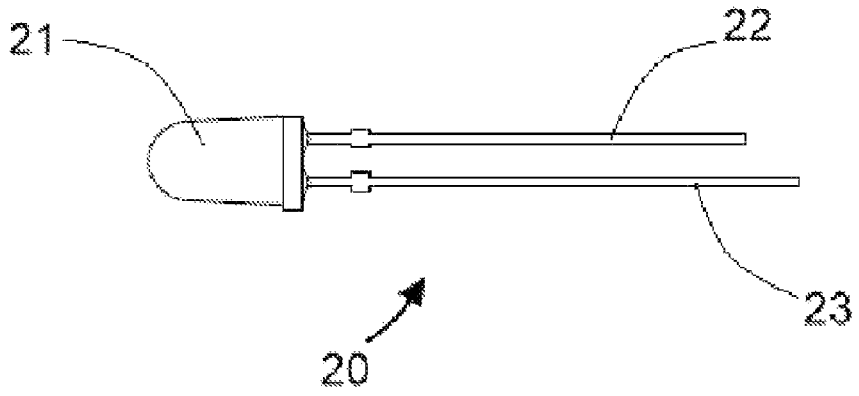
FIG. 1 is a side view of an LED having two lead wires (before installation)
Figure 2:
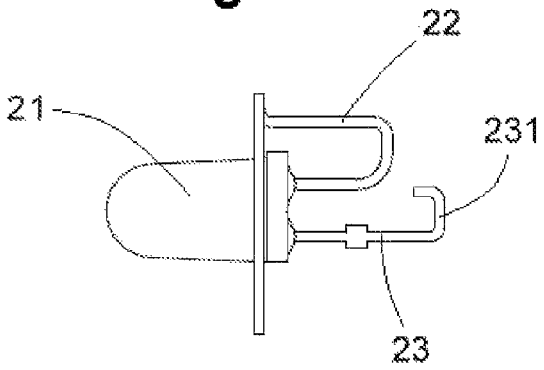
FIG. 2 is a side view showing the same LED after insertion through the holes of the holder (not shown) and appropriate bends.
Figure 3:
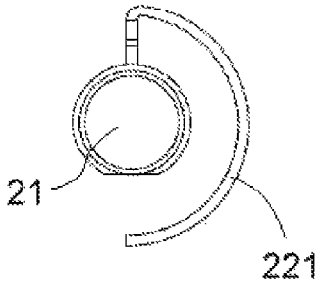
FIG. 3 is a bottom view of the diode of FIG. 2.

As seen in FIG. 1, a standard LED 20 has a light-emitting head 21 and integral two lead wires 22 and 23 projecting from the bottom of the head 21. These wires 22 and 23 have the shape seen in FIGS. 2 and 3 after being installed as described below in a holder with the appropriate bending and insertion through holes in the holder. At is bottom end, lead wire 23 is bent like a hook with its outer end 231 in a U-shape so as to form a contact line or contact surface with a positive battery pole of a battery or of the top-most battery of a battery stack. The lead wire 22 is bent radially outward and then bent upward and around to a partially ring-shaped or arcuate end 221 that, for example, rests as described below on the conductive end face of a battery casing, and connects through the casing wall to the negative battery pole.

Figure 4:
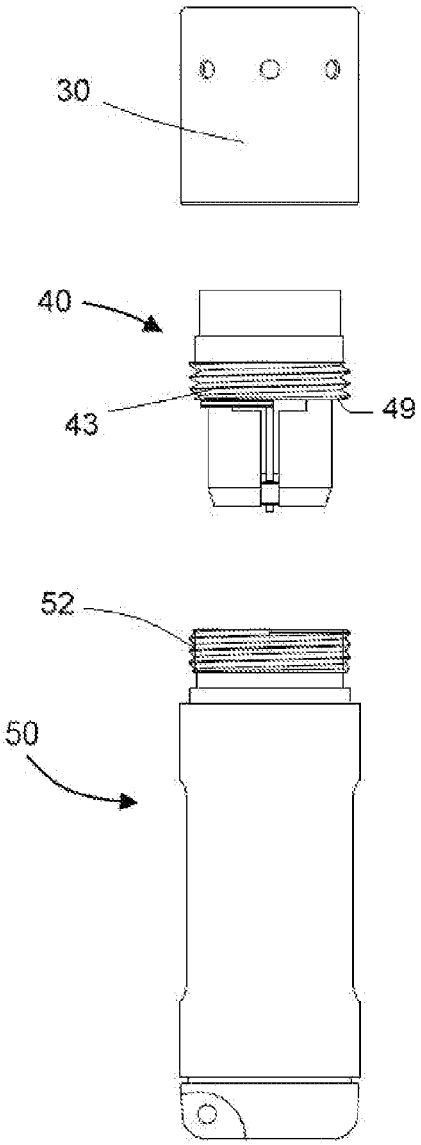
FIG. 4 is an exploded side view of a flashlight having a flashlight head, a lamp holder, and a flashlight casing.
Figure 5:
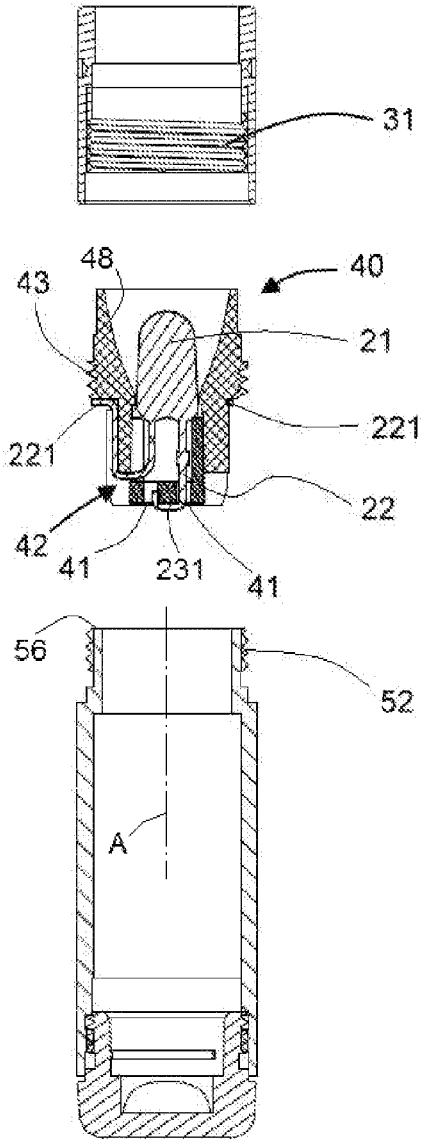
FIG. 5 is a longitudinal section through the same structure as in FIG. 4.
Figure 6:
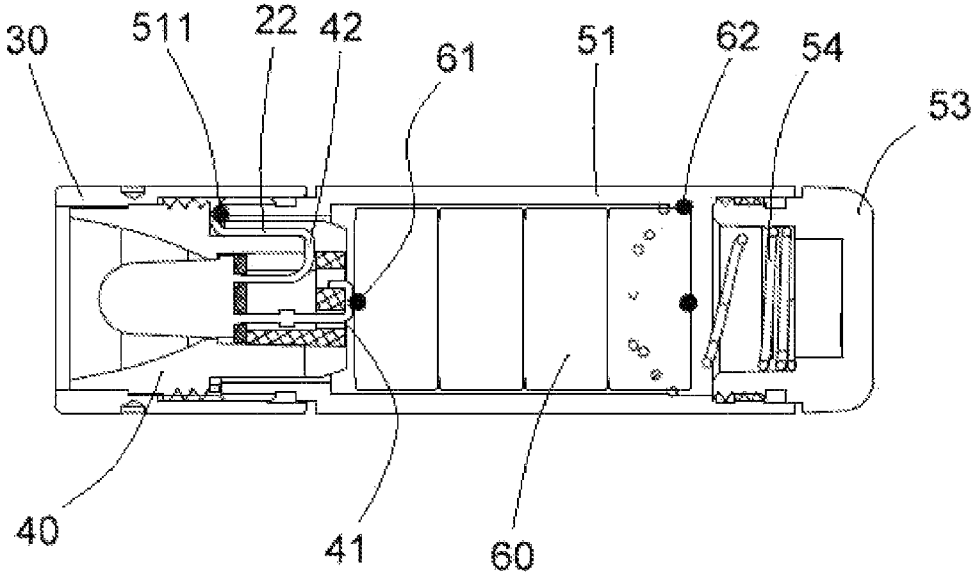
FIG. 6 is a longitudinal section through a completely assembled flashlight as in FIG. 4.
Figure 7:
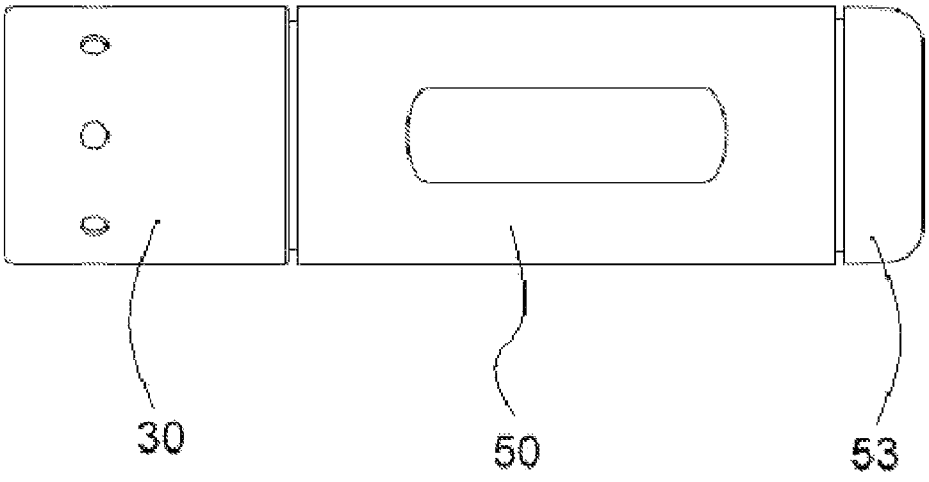
FIG. 7 is a side view of the flashlight as in FIG. 6.
Figure 8A:
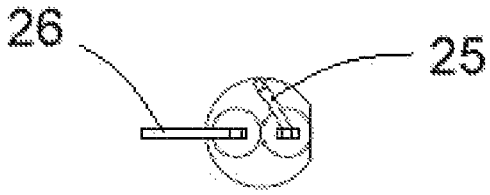
FIGS. 8A, 8B, and 8C are bottom, side, and top views of another diode with bent lead wires that match the shape of another holder.
Figure 8B:
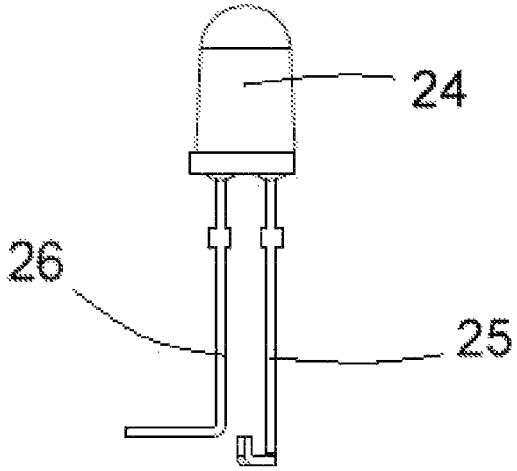
Figure 8C:
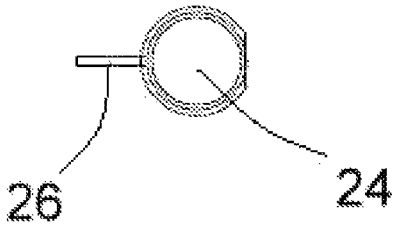
Figure 10:
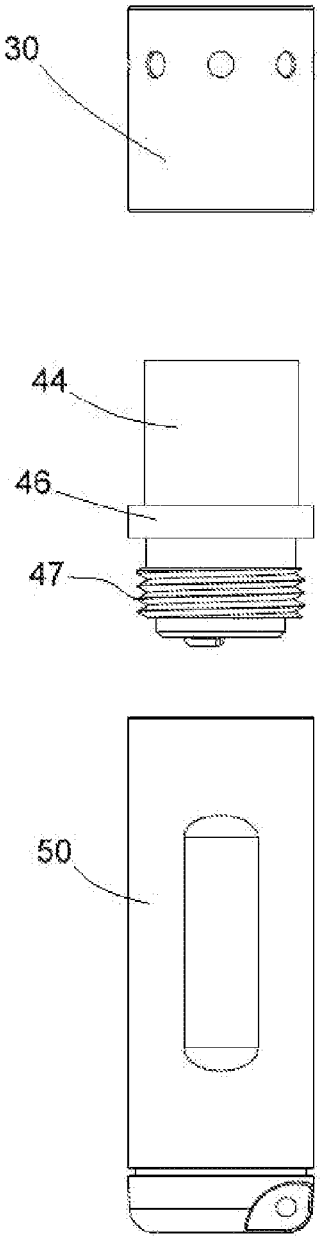
FIGS. 10 and 11 are exploded side and longitudinal sectional views of a flashlight similar to that of FIGS. 1-7 with a head, a holder, and a casing.
Figure 11:
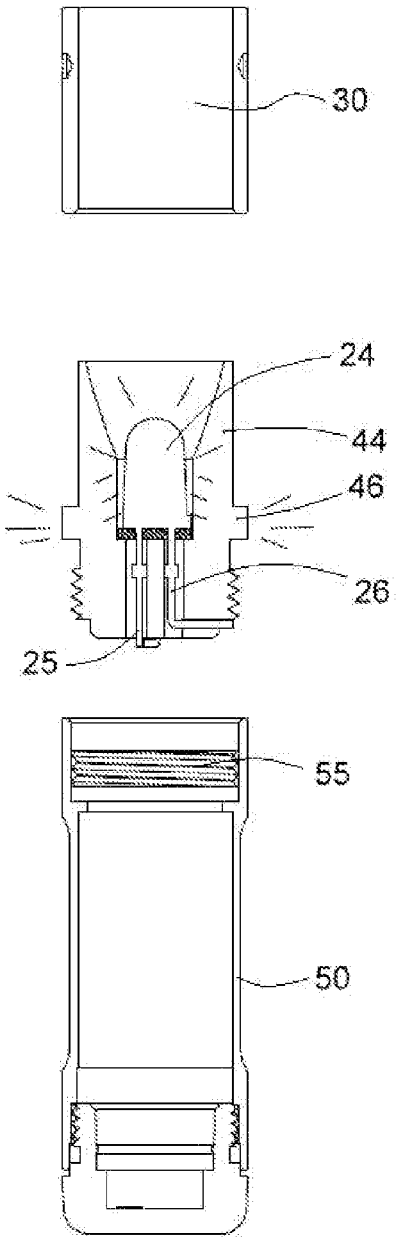

In the exploded views of FIGS. 4 and 5, the flashlight is composed of a flashlight head 30 formed as a cylindrical collar, a one-piece holder 40, as well as a flashlight casing 50, all extending along and centered on an axis A. The one-piece holder 40 is designed as a concave reflector with a reflective parabolic inner surface 48 and functions to secure the diode 20. It base has two holes 41 and an additional hole 42. The lead wire 22 is inserted through the first hole 41 of the base of holder 40, then bent up at its free end and inserted into the other axially extending hole 41. The end 231 of this lead wire 23 creates a contact 61 at one end of a stack of four batteries 60, as seen in FIG. 6. A second contact 62 is created by the side surface of the side wall 51 to a contact 511 that engages with the free end 221 of the bent lead wire 22. This lead wire 22 passes radially outward through the second hole 42 and is bent upward to rest snugly on the holder 40 with its part-circular arcuate end 221 and thereby engage the bottom face of a shoulder of the holder 40.

The end 231 of the lead 23 lies on an inner end face of the holder 40 while the lead 22 is recessed beneath this end face in a groove and then extends radially out of the holder 40. Thus only the lead 23 will contact the positive pole of the battery pack in the casing 50, and the lead 22 will not.

The holder 40 is an injection-molded plastic part that has an external thread 43 that fits with an internal thread 31 in the flashlight head 30. At its top end facing flashlight head 30 or holder 40, the flashlight head 50 has an external thread 52 that is also designed to correspond to the internal thread of flashlight head 30. The holder 40 is designed so that it can be inserted into the top opening of the flashlight casing 50 with the loop end 221 of the lead wire 22 bearing on the axially downwardly directed face of a shoulder 49 formed below its screwthread 43.

When the flashlight head 30 is then placed over the holder 40, the holder 40 can initially be attached by the thread 43, and, when the flashlight head 40 is screwed on further, its internal thread 43 also engages an external thread 52 of the flashlight casing 50 and acts to provide a secure strong seating for the holder 40. The flashlight casing is closed at its bottom end by a cap 53 that includes a spring 54 that presses the stack of batteries 60 together, thereby ensuring the requisite electrical contact.

The flashlight head 30 in this case is provided with a rotary switch so that the free end 221 of the lead wire 22 can engage at different positions on an end face 56 of the flashlight casing 50 in response to turning the flashlight head 30 with the holder 40. To this end one portion of the face 56 is insulated and the other not, so that when the 221 engages only the insulated position the circuit from the batteries 650 through the light-source LED 20 is closed and when it engages the uninsulated portion the circuit is closed and the lamp 20 is illuminated.

Figure 12:
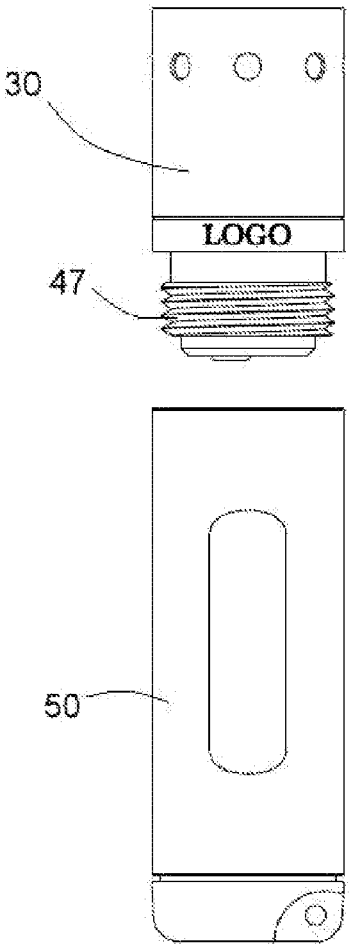
FIGS. 12 and 13 are exploded side and longitudinal sectional views of the flashlight of FIGS. 10 and 11 partially assembled.
Figure 13:
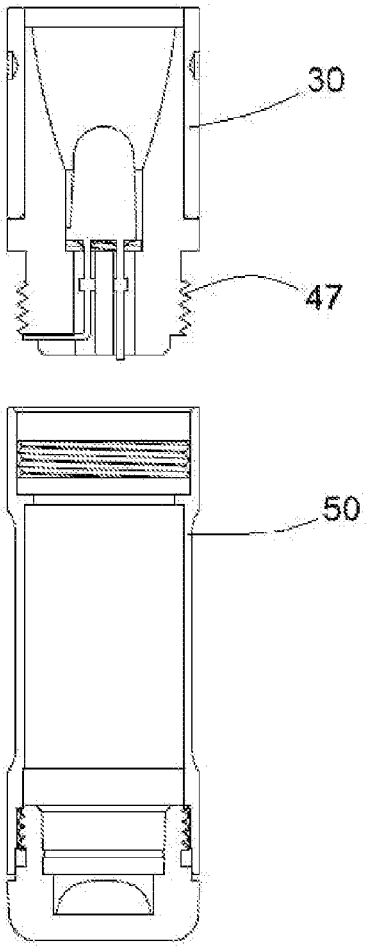
Figure 14:
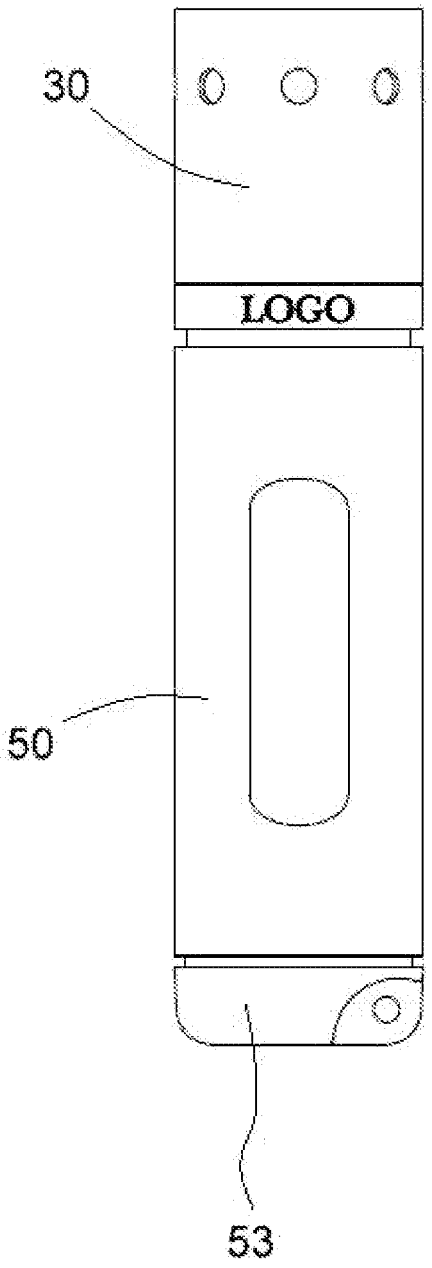
FIG. 14 is a side view of a completely assembled flashlight as in FIGS. 10 and 11.

FIGS. 8A-9C show a diode 24 along with lead wires 25 and 26 is secured in a holder 44 similar to that of FIGS. 1-7. As has already been described, the lead wire 25 is also bent over at its free end into a U-shape, whereas the lead wire 26 is simply bent radially outward where it rests on a shoulder below the thread 45. In contrast to the above-described embodiment, the holder 44 has a collar-like annular ridge 46 that projects radially outward. As is especially visible in FIG. 12 and FIG. 13, the cylindrical outer surface of this ring-shaped projection fits flush with the cylindrical outer surface of the flashlight head 30 and/or with the cylindrical outer surface of the casing 50. As is identified at "LOGO" in FIG. 12, this flashlight ring can be provided with engraved indicia that displays a company symbol or other information. The holder 44 is made of a translucent material so as to appear as a luminous ring from the outside when the flashlight is turned on in the assembled state.

In the embodiment of FIGS. 10 through 13, the thread 47 of the holder 44 engages an internal thread 55 of the flashlight casing, so the flashlight head 30 in this case is mounted on the holder 44 by friction, unless an additional threaded connection is provided between the flashlight head 30 and the top section of the holder 44.

The particular advantage of this invention is the fact that the diode 20 or 24 is easily secured within the holder 40 or 44, and the contacts to the flashlight-side contact points can be provided without laborious soldering. The lead wires are securely embedded in the holder 40 or 44 and thus protected against breakage as well as undesirable short circuits. Installation of the diode 20 or 24 into the holder 40 or 44 as well as the bending over of the lead wires can be done in an automated process. Assembly of the holder with the installed diode, and of the flashlight body and flashlight head is restricted to a simple screw-type motion. Once the flashlight is completely assembled, it is also possible to replace the holder for repair purposes or in order to replace the diode, since the holder together with the diode is easily replaceable without additional tools or special dexterity by a nonexpert.

I claim:

1. A flashlight comprising:

a casing extending along an axis, formed with a screwthread, and holding a battery having two poles;

a light-emitting diode having a light-emitting head and a first and second integral lead wires; and a one-piece holder formed with a first axially open throughgoing hole, a second separate radially open throughgoing hole, a seat into which the holes open and in which the diode head is fitted with the first and second wires extending outward through the respective first and second holes out of contact with each other, a reflector adjacent the seat, respective screwthreads on the casing and on the holder, and a shoulder having an annular face directed axially inward and axially aligned with a side wall of the casing, the second hole opening at the annular face, the screwthreads being oriented such that the holder can press the second wire with the annular face against an end of the casing, the holder being fitted to the casing with the screwthread of the holder operatively engaged with the screwthread of the casing and the first wire pressed directly against one of the poles of the battery.

2. The flashlight defined in claim 1, further comprising a head collar attached to the holder.

3. The flashlight defined in claim 1, wherein the casing is conductive and other pole of the battery is in electrical connection with the casing, the holder being rotatable on the casing between a position pressing the other wire of the diode against the casing and an angularly offset position with the other wire out of electrical contact with the casing.

4. The flashlight defined in claim 1, wherein the holder has an axially inwardly directed face at which the first hole opens axially and on which a third hole opens into which an end of the one lead wire engages, a short section of the one lead wire between the first and the third holes extending in a plane perpendicular to the axis and lying on the face of the holder.

5. The flashlight defined in claim 1, wherein the screwthread of the holder is an external screwthread and the screwthread of the casing is a complementary internal screwthread.

6. The flashlight defined in claim 5, further comprising:

a head collar fitted to the holder.

7. The flashlight defined in claim 6, wherein the holder is of translucent plastic and has a radially projecting ridge exposed between the collar and the casing, whereby light from the diode is diffused through the ridge.

8. The flashlight defined in claim 7, wherein the ridge is provided with indicia.

9. The flashlight defined in claim 1, wherein the screwthreads of the holder and the casing are short, external, and of identical hand, pitch, and diameter, the flashlight further comprising:

a head collar formed with a long internal screwthread complementary to the screwthreads of the holder and casing and fitted thereto to hold the collar, holder, and casing together.

* * * * *